US010330384B2

(12) United States Patent
Leung et al.

(10) Patent No.: US 10,330,384 B2
(45) Date of Patent: Jun. 25, 2019

(54) DRYING DEVICE

(71) Applicant: OllieBud LLC, Irvine, CA (US)

(72) Inventors: Jessica Leung, Irvine, CA (US); Gabriel Cappelli, Irvine, CA (US)

(73) Assignee: OllieBud, LLC, Spokane, WA (US)

( * ) Notice: Subject to any disclaimer, the term of this patent is extended or adjusted under 35 U.S.C. 154(b) by 229 days.

(21) Appl. No.: 15/215,577

(22) Filed: Jul. 20, 2016

(65) Prior Publication Data

US 2017/0023299 A1 Jan. 26, 2017

Related U.S. Application Data

(60) Provisional application No. 62/194,643, filed on Jul. 20, 2015.

(51) Int. Cl.

| | |
|---|---|
| ***F26B 5/16*** | (2006.01) |
| ***A47L 23/20*** | (2006.01) |
| ***F26B 21/00*** | (2006.01) |
| ***F26B 21/08*** | (2006.01) |

(52) U.S. Cl.

CPC ..... *F26B 5/16* (2013.01); *A47L 23/20* (2013.01); *F26B 21/006* (2013.01); *F26B 21/083* (2013.01)

(58) Field of Classification Search

CPC ..... F26B 5/16; F26B 21/006; F26B 21/083; A47L 23/20

USPC ..... 34/443

See application file for complete search history.

(56) References Cited

U.S. PATENT DOCUMENTS 2,380,339 A * 7/1945 Siedentopf ..... A61L 2/02 34/410
2,591,055 A * 4/1952 Dietert ..... B01L 1/02 312/31.1
3,545,177 A * 12/1970 Hodgson ..... B01D 53/26 95/10
4,050,164 A * 9/1977 Campbell ..... F26B 3/06 34/182
4,677,764 A * 7/1987 Cerny ..... F26B 9/10 34/195
4,922,626 A * 5/1990 Fiddler ..... F26B 9/003 34/80
5,165,947 A * 11/1992 Colucci ..... A23B 7/148 206/204
5,180,075 A * 1/1993 Montalbano ..... B65D 77/042 229/103.11
6,264,895 B1 * 7/2001 Johnson ..... B01D 3/10 34/80
6,399,920 B1 * 6/2002 Guinn ..... F26B 9/003 219/386
6,829,844 B2 * 12/2004 Brady ..... B09C 1/06 34/235

(Continued)

FOREIGN PATENT DOCUMENTS

GB 748462 A * 5/1956 ..... G01N 27/223

*Primary Examiner* — Stephen M Gravini
(74) *Attorney, Agent, or Firm* — Richards Patent Law P.C.

(57) ABSTRACT

An apparatus for drying an item includes a container including a width and a height, an insert including a planar surface positioned parallel to the width at a first point along the height, wherein the insert surface includes a plurality of openings, a perforated tray positioned parallel to the width at a second point along the height between the insert and a bottom of the container, and a desiccant material positioned on the tray.

28 Claims, 13 Drawing Sheets

(56) References Cited

U.S. PATENT DOCUMENTS

| | | | | |
|---|---|---|---|---|
| 8,266,819 | B2 * | 9/2012 | Zillmer | B01D 53/261 34/378 |
| 9,605,375 | B2 * | 3/2017 | Frank | D06F 58/28 |
| 9,863,699 | B2 * | 1/2018 | Corbin, III | F26B 5/06 |
| 2003/0079363 | A1 * | 5/2003 | Soucy | F26B 3/286 34/60 |
| 2017/0023299 | A1 * | 1/2017 | Leung | F26B 5/16 |

* cited by examiner

DRYING DEVICE

CROSS-REFERENCE TO RELATED APPLICATIONS

This application incorporates by reference and claims the benefit of priority to U.S. Provisional Application No. 62/194,643 filed on Jul. 20, 2015.

BACKGROUND OF THE INVENTION

The present invention relates to a device for rapidly drying items in an enclosed container. More specifically, the present invention relates to a device for rapidly drying items such as shoes, socks, or other athletic gear by optimizing the efficiency of a desiccant while providing direct airflow between the desiccant and an interior of the item within an enclosed container.

Sweaty, damp or wet shoes, socks, stockings, or other athletic gear or clothing often provide an ideal environment for the growth of odor-causing bacteria and/or odor-causing fungus. Dampness may result from daily wear or athletic activity, particularly in shoes made of fabrics having low air permeability and/or shoes worn without socks. Repeated use of damp shoes and socks also causes blisters or other discomfort in addition to odors.

A number of inserts and sprays currently on the market are designed to eliminate odors and/or remove moisture from shoes and socks. Some products merely attempt to mask the odor with another scent. Such products do not kill the bacteria or remove the moisture, which often leads to a recurrence of the odor. Other products attempt to kill odor-causing bacteria with alcohol or other chemicals or by introducing another competing bacteria and/or enzymes, but these products do not remove moisture and often fail to eliminate all of the bacteria, which can lead to odor recurrence. Some products attempt to kill bacteria using UV light rays, but such products tend to be expensive. Further, most inserts and sprays require a long period of time to produce noticeable or adequate results. The scents, chemicals, and other bacteria or enzymes may cause allergic reactions or otherwise be unpleasant or uncomfortable for the user.

With regard to inserts in particular, there are a number of inserts on the market specifically to remove moisture from the shoe. The insert is filled or coated with or made from a desiccant material and is typically shaped to fit within the shoe. Such inserts are often ineffective for a number of reasons. The insert is exposed to a room or other large area while inside the shoe, and therefore is removing moisture from the large area as well as the shoe, reducing its effectiveness. The efficiency of the desiccant is also limited by the surface area of the desiccant in contact with the moisture in the air. The insert may also trap moist air in the shoe if the desiccant is insufficient or inhibited due to surface area limitations. In addition, it is often not clear when the desiccant has been exhausted or saturated. The desiccant material must also maintain its shape as it adsorbs moisture, in contrast to more efficient desiccant materials that may become softer with adsorption.

Accordingly, there is a need for a drying method that effectively and efficiently removes moisture from damp shoes, socks, and similar objects, thereby killing odor-causing bacteria and/or preventing the bacteria from growing, in a short period of time.

SUMMARY OF THE INVENTION

The present invention solves the above-mentioned problems by providing a device for rapidly drying items such as shoes and athletic gear by optimizing the efficiency of a desiccant while providing direct airflow between the desiccant and an interior of the object within an enclosed container. The device includes an enclosed container that houses a desiccant material disposed atop a perforated tray near the bottom of the container. A perforated insert having one or more upright members thereon is positioned above the tray. In one embodiment, the container includes a gasket to increase the airtightness of seal. In another embodiment, the enclosed container houses a fan.

The upright members or shoe forms are shaped to direct airflow into, around or toward the damp item, such as, into the interior of the shoe. The upright member may include four strips of material that extend upwardly from the insert between extending between a proximal base and a distal end. In one embodiment, projections extend from the base of the upright member into the openings of the insert. In other embodiments, the upright member may be formed integrally or permanently adhered to the insert.

In a further embodiment, each upright member or shoe form includes an angled opening extending downwardly from an outer end toward an inner end. In an example where the damp item is a shoe, the shoe is turned over such that the sole of the shoe faces upward and the laces face downward. The shoe opening where the foot is inserted into the shoe is positioned about the upright member. Airflow between the desiccant and the interior of the shoe is uninhibited. Other items such as socks and stockings may be similarly positioned over the shoe form for drying.

In another embodiment, each shoe form includes two parts, each part having three pins extending from a rod. Each part is secured to the insert by positioning the pins through the openings of the insert. The user may select the locations and spacing of the shoe form parts in order to position the damp item in such a way to optimize airflow into and/or toward the damp item.

Additionally, certain features of the device allow for optimal use of the desiccant. By using an enclosed container, the amount of air from which moisture is removed by the desiccant is limited. In some embodiments, the device includes a gasket to provide an airtight container. In other embodiments, the gasket may be integral with the container and formed as part of the mold, rather than a separate component. The use of a fan increases air movement, allowing the moisture to be removed from the air more quickly. Additionally, the spacing of the desiccant away from the shoe allows for the use of an efficient desiccant such as anhydrous calcium chloride, which does not need to retain its shape as it adsorbs moisture. The desiccant may be disposable and/or removable.

Further, the perforated tray enables the desiccant to continuously remove moisture from the air while allowing water to drain through the tray to the bottom of the container. The tray can easily be removed from the device in order to clean the bottom of the container and to replace the desiccant as necessary.

The desiccant is readily visible in the tray at the bottom of the container when the container is open, thus often making it visually evident if the desiccant has been saturated or exhausted due to the absorption of water.

The device can be stored anywhere such as at home, in the garage, at work, or in the car. For example, shoes that are worn daily such as running or climbing shoes can be positioned in the device in the car after practice, and will be ready for wear the following day.

In one embodiment, an apparatus for drying an item includes a container including a width and a height, an insert including a planar surface positioned parallel to the width at a first point along the height, wherein the insert surface includes a plurality of openings, a perforated tray positioned parallel to the width at a second point along the height between the insert and a bottom of the container, a desiccant material positioned on the tray.

An advantage of the present design is the quick and efficient removal of moisture from an item, thereby also leading to the prevention and elimination of odor-causing bacteria from the damp items. This aspect is enabled as most odor-causing bacteria reproduce more rapidly in a damp or moist environment.

Another advantage of the present design is the ability to use efficient desiccants to remove moisture from an item within a limited volume of air.

A further advantage of the present design is to provide direct, unobstructed airflow into an interior of a shoe, resulting in the efficient removal of moisture therefrom.

A further advantage of the present design is the avoidance of additional fragrances, enzymes, bacteria, or scents. The present design also avoids placing chemicals in direct contact with the item being dried.

Another advantage of the present design is the portability and convenience of use at home, in the garage, at the office, in the car, etc.

BRIEF DESCRIPTION OF THE DRAWINGS

The drawing figures depict one or more implementations in accord with the present concepts, by way of example only, not by way of limitation. In the figures, like reference numerals refer to the same or similar elements.

DETAILED DESCRIPTION OF THE INVENTION

Figure 1:
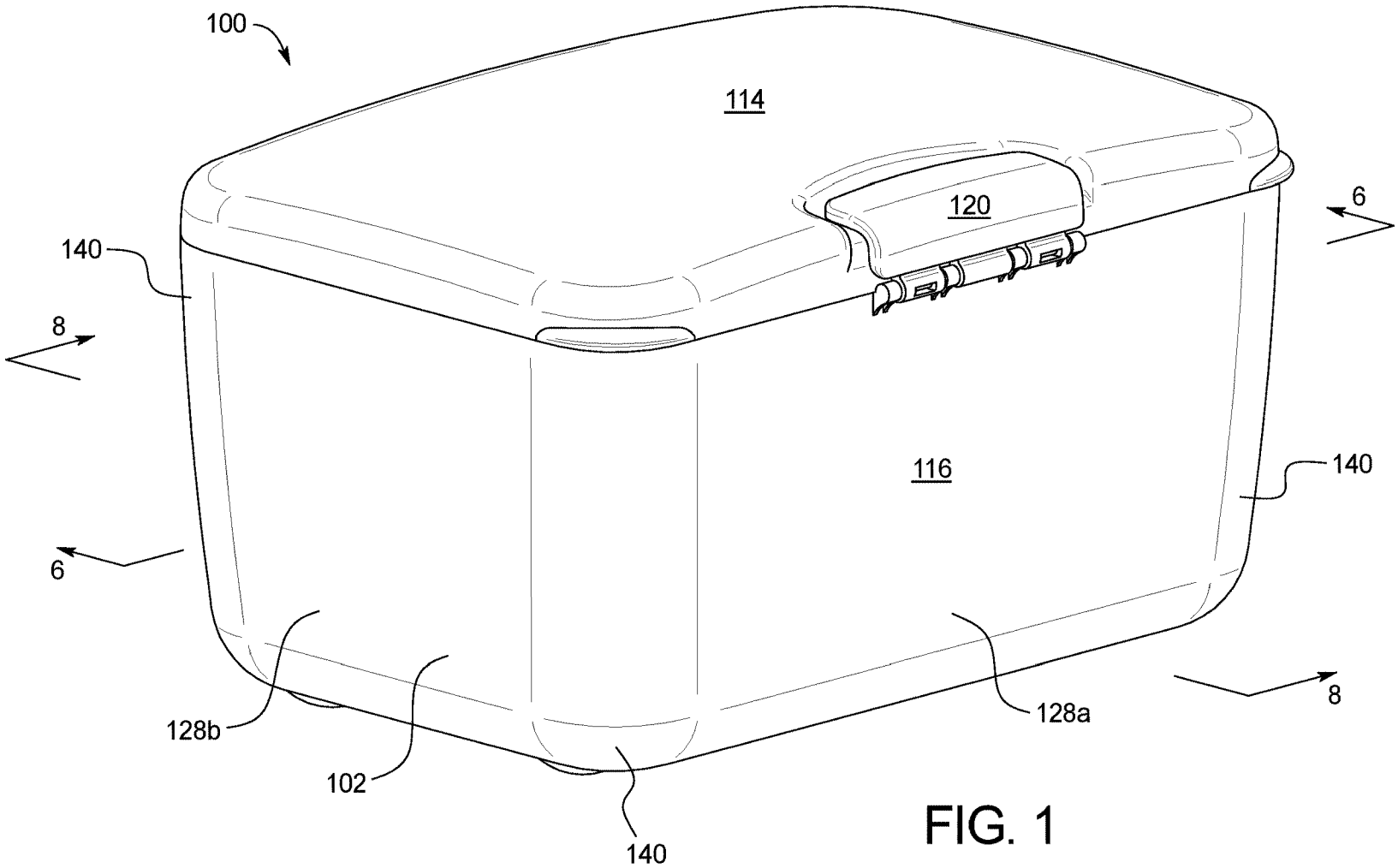
FIG. 1 is an isometric view from above of the front of a drying device in accordance with the present disclosure.

In order to meet these needs, the present invention discloses a drying device 100 for quickly and efficiently removing moisture from damp items.

As illustrated by FIGS. 1-10, the drying device 100 includes a container 102 that houses an insert 104 onto which a damp item 106, such as a shoe or socks, is placed and that is spaced above a desiccant material 108 resting on a tray 110. Specifically, the insert 104 maintains the damp item 106 in an optimal position for effective removal of moisture. The removal of moisture from an interior 112 of the damp item 106 leads to the prevention and elimination of odor-producing bacteria.

Figure 2:
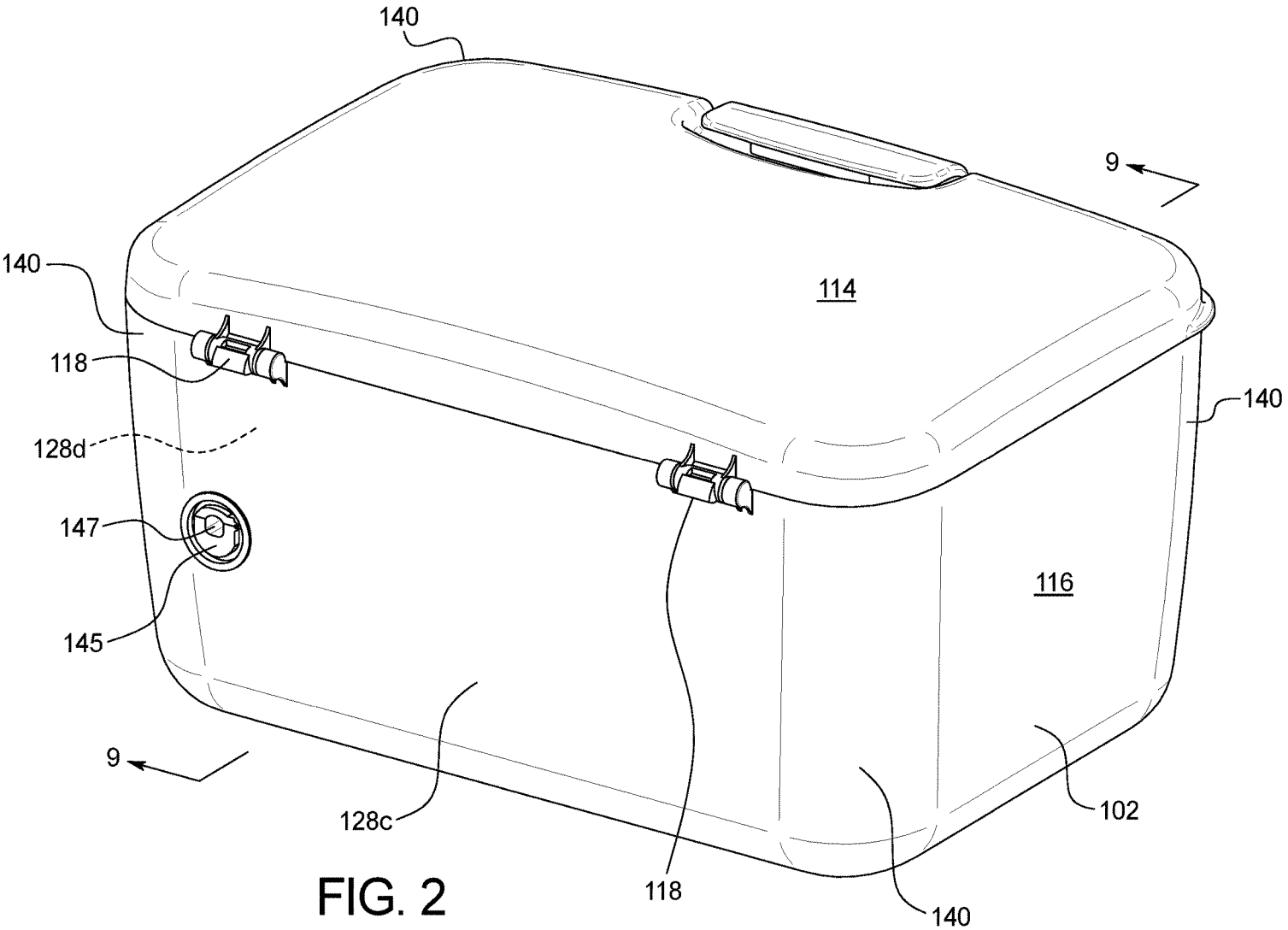
FIG. 2 is an isometric view from above of the back of the drying device of FIG. 1.
Figure 3:
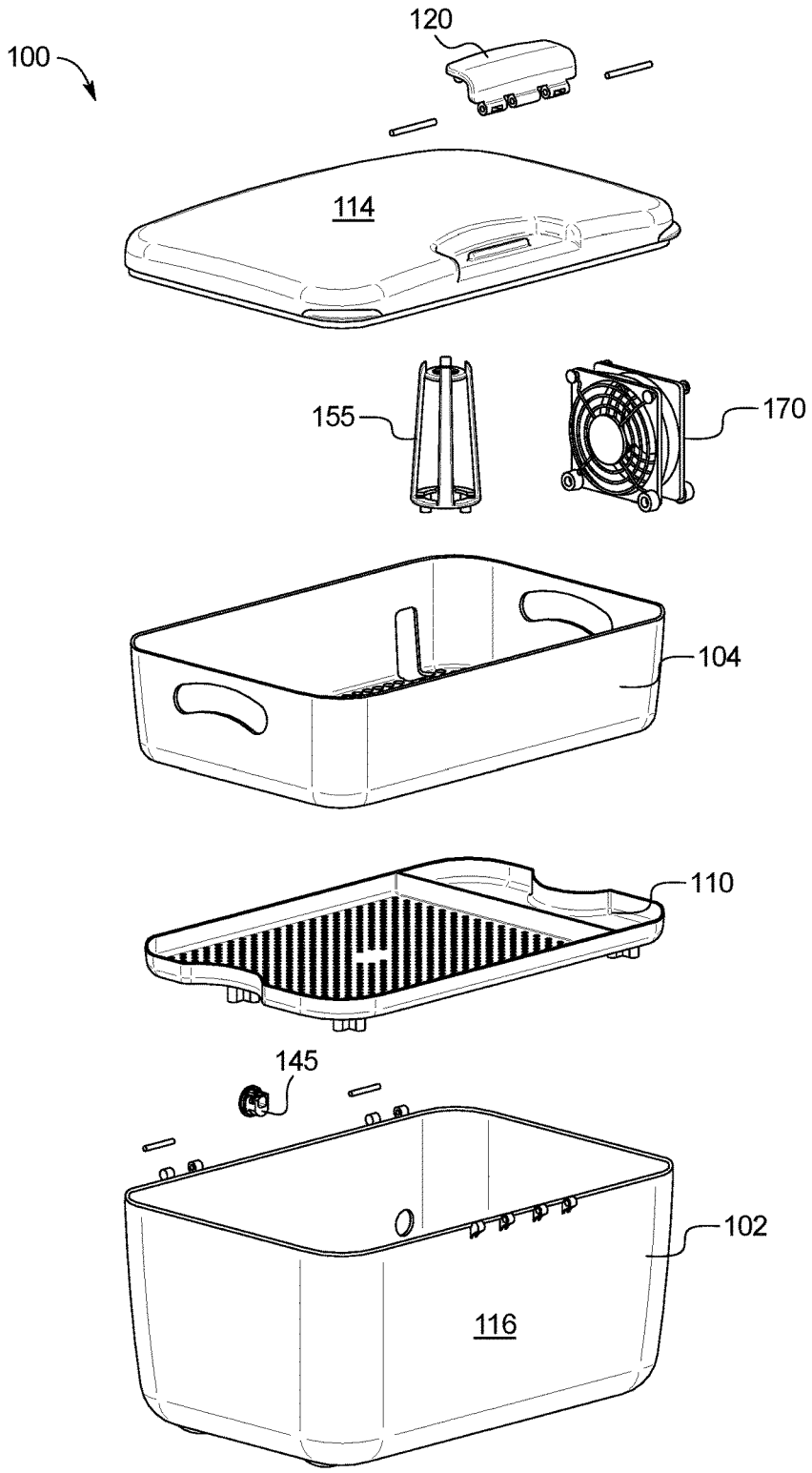
FIG. 3 is an exploded, isometric view from above of the drying device of FIG. 1.

As shown in FIGS. 1 and 2, the container 102 includes a lid 114 disposed atop a body 116. In one embodiment, the lid 114 rotates about one or more fastening devices 118 such as hinges secured to the body 116. A further fastening device 120 such as a latch on the body 116 opposite the fastening devices 118 maintains the lid 114 in a closed position. Each of the hinges 118 and latch 120 may include connectors such as screws or pins. In another embodiment, a fully detachable lid may be secured to the body 116 using two or more fastening devices 120. It is preferred but not necessary for the container 102 to be airtight in order to limit the volume of air from which moisture is removed.

Figure 13:
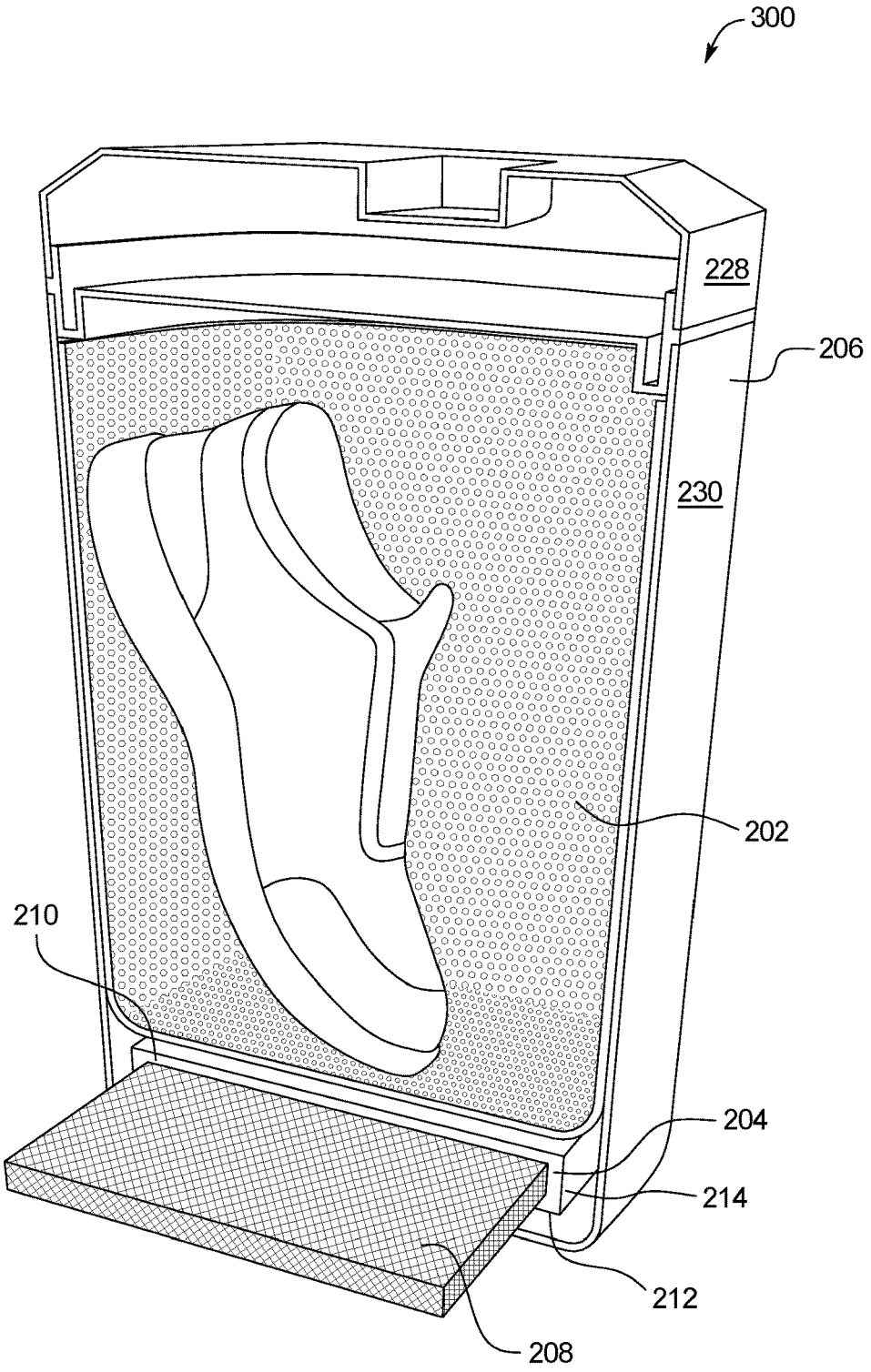
FIG. 13 is a sectional view of the drying device generally taken along the lines 13-13 of FIG. 11.

In one embodiment, a gasket may be positioned between the lid 114 and the body 116 to create an airtight seal when the lid 114 is in the closed position as shown in FIG. 1. A handle or other carrying device may be secured to the lid 114. Although the illustrated embodiment has a rectangular-shaped container 102, the container 102 may have another shape such as rounded, square, cylindrical or the like. Further embodiments of the container 102 are shown in FIGS. 13-15.

Figure 4:
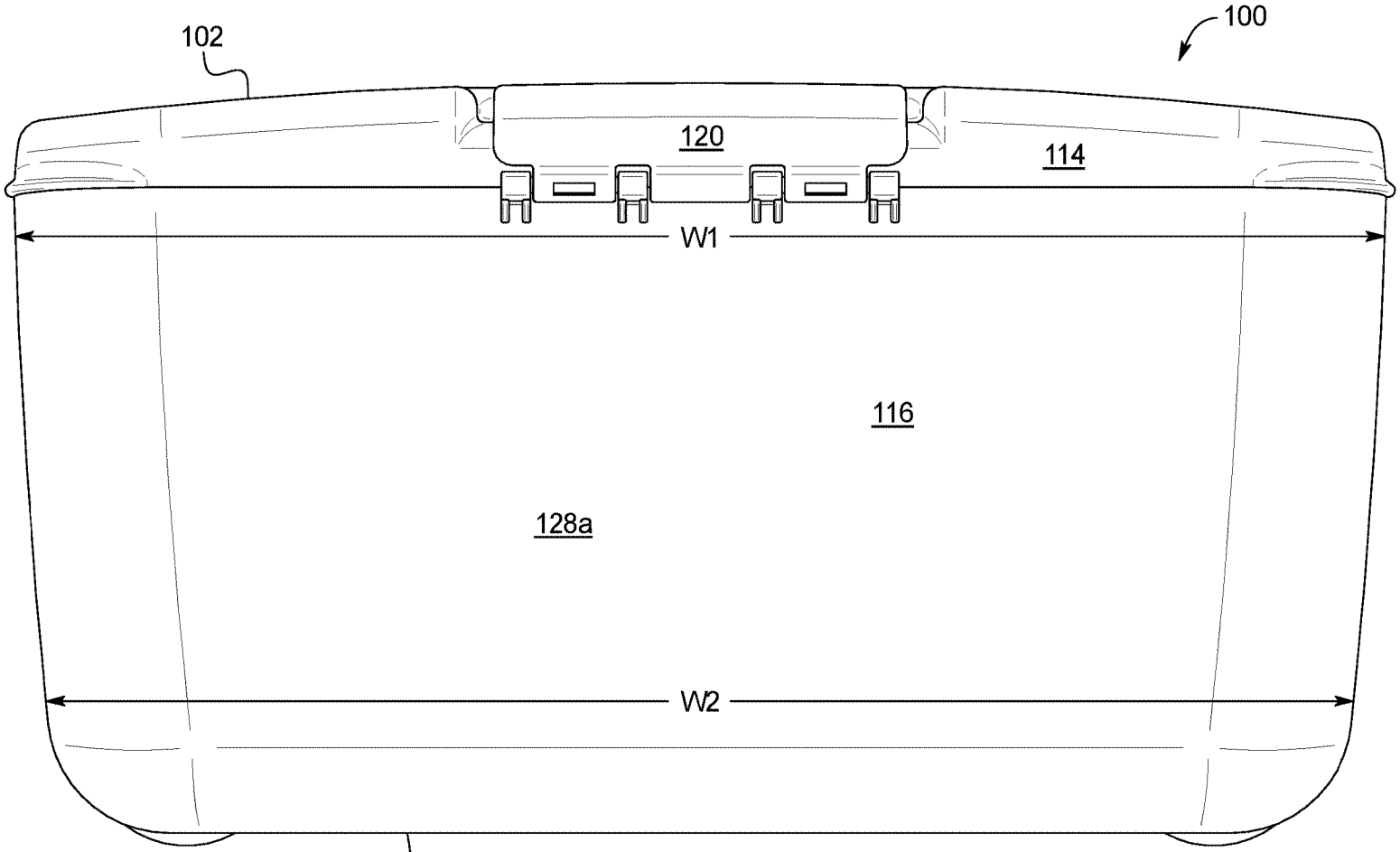
FIG. 4 is a front elevational view of the drying device of FIG. 1.
Figure 5:
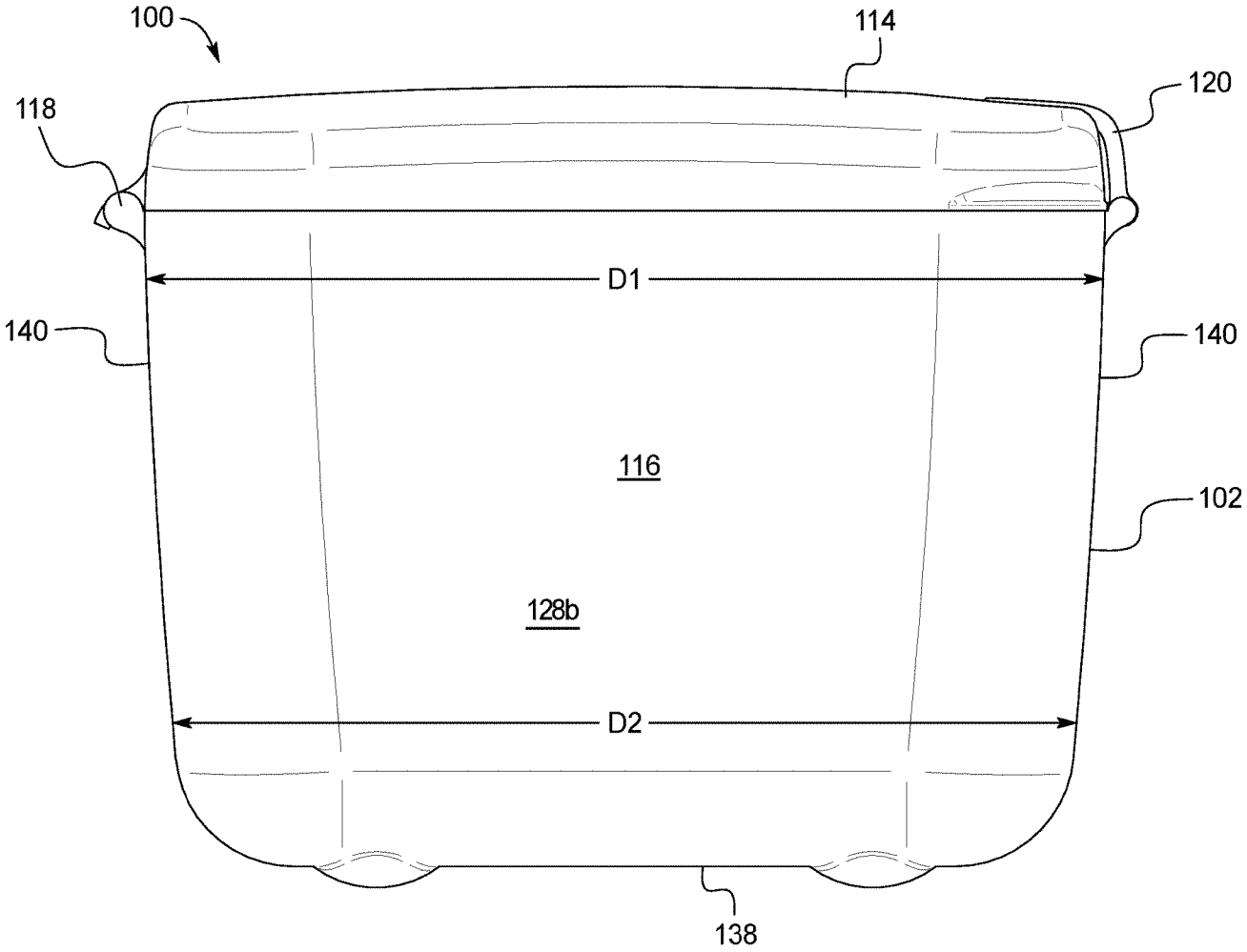
FIG. 5 is a side elevational view of the drying device of FIG. 1.

Referring to FIGS. 1-5, the container body 116 includes first, second, third, and fourth container sides **128*a*-128*d* disposed about a bottom surface 138 opposite the lid 114. As shown in FIGS. 4 and 5, the container sides 128*a*-128*d* taper inwardly from a first width W1 and a first depth D1 adjacent the lid 114 to a second width W2 and a second depth D2 adjacent the bottom 138. The four corners 140 of the container 102 may be rounded as shown in FIGS. 1 and 2**, square, or have any other geometry.

As shown in FIGS. 6-9, the insert 104 includes insert sides **142*a*-142*d* extending from an insert surface 144 that nest within the container sides 128*a*-128*d*. The insert sides 142*a*-142*d* are tapered in order to nest within the tapered container sides 128*a*-128*d*, thereby maintaining the positioning of the insert 104 spaced from the bottom 138 of the container 102. A plug 145 may extend through a hole in one of the container sides 128*c* and one of the insert sides 142*c*. The hole in the container side 128*c* allows for (1) installation of a rubber plug 145 that limits the airflow into and out of the container, (2) installation of a strain relief 147**, allowing a cable to pass from inside the container to outside the container while also limiting the airflow into and out of the container (the cable is used to power the fan inside the box) and/or (3) installation of a panel mount USB receptacle while also limiting the airflow into and out of the container. The fan inside the box can be plugged into the mounted USB receptacle. The receptacle is connected to a power supply outside the box, which powers the fan.

In some embodiments, the insert surface 144 is approximately about 3 to about 5 cm above the bottom 138 of the container 102, although the distance between the insert surface 144 and the bottom 138 may vary depending on the size, shape, geometry, and other variables of the container and insert. Openings 152 formed in the insert surface 144 allow air and water to flow through. In some embodiments, the insert 104 may include openings on the side surfaces **142*a*-142*d* as well. Openings for hands 143, finger cut-outs, or other lifting attachments may be formed within or attached to the insert 104**.

In the illustrated embodiment, the container sides **128*a*-128*d*** are planar. In other embodiments, each container side

128*a*-128*d* may have an upper portion and a lower portion joined at an interface thereof. Each upper portion may be vertical, and each lower portion may angle inwardly from the interface towards a perimeter of the bottom surface. In this embodiment, each insert side may include an upper portion and a lower portion joined at an interface. The interface of the insert sides aligns with the interface of the container sides during use, as the lower portions of the insert sides rest on the lower portions of the container sides.

Figure 6:
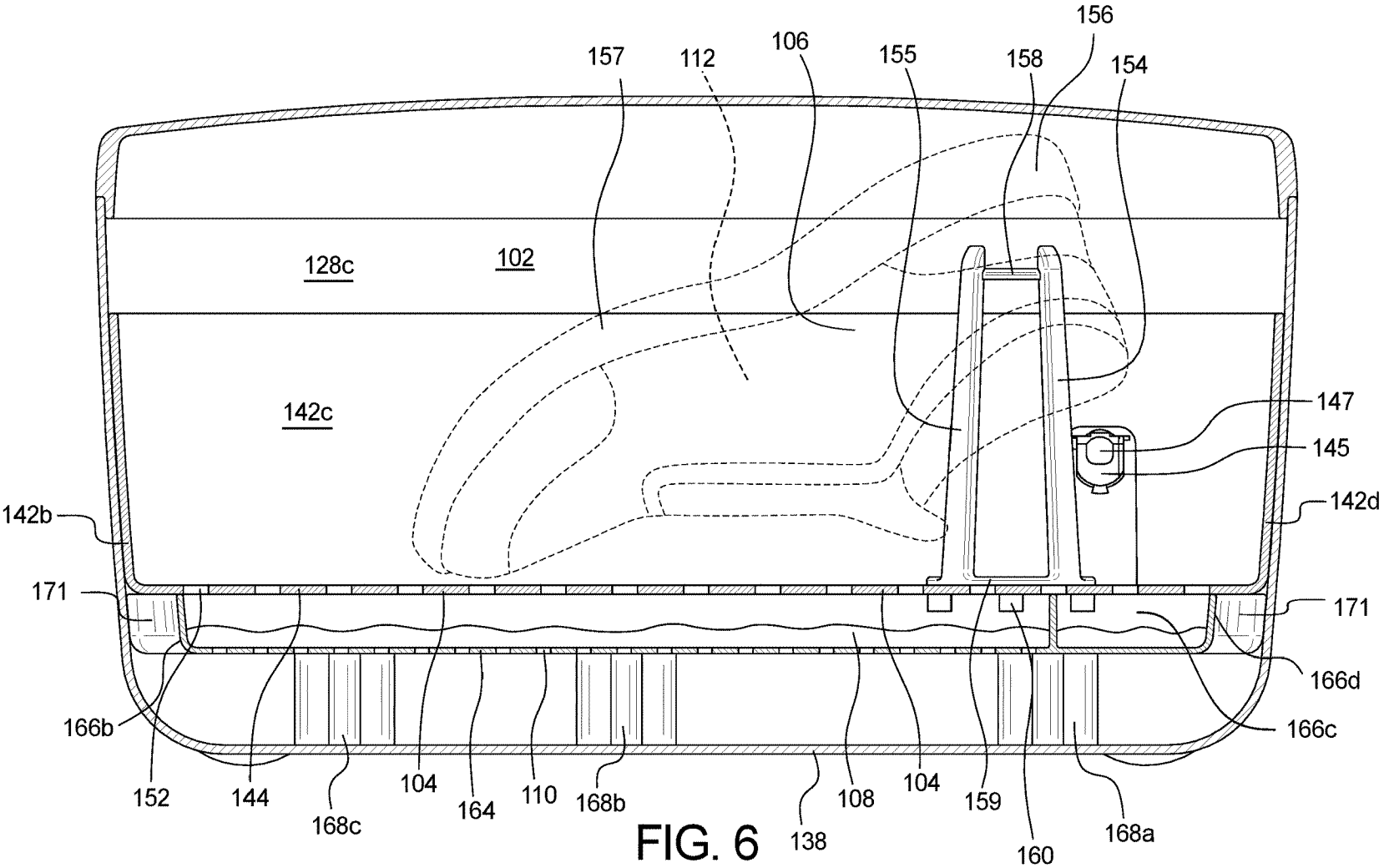
FIGS. 6 and 7 are sectional and isometric views of the drying device generally taken along the lines 6-6 of FIG. 1.
Figure 7:
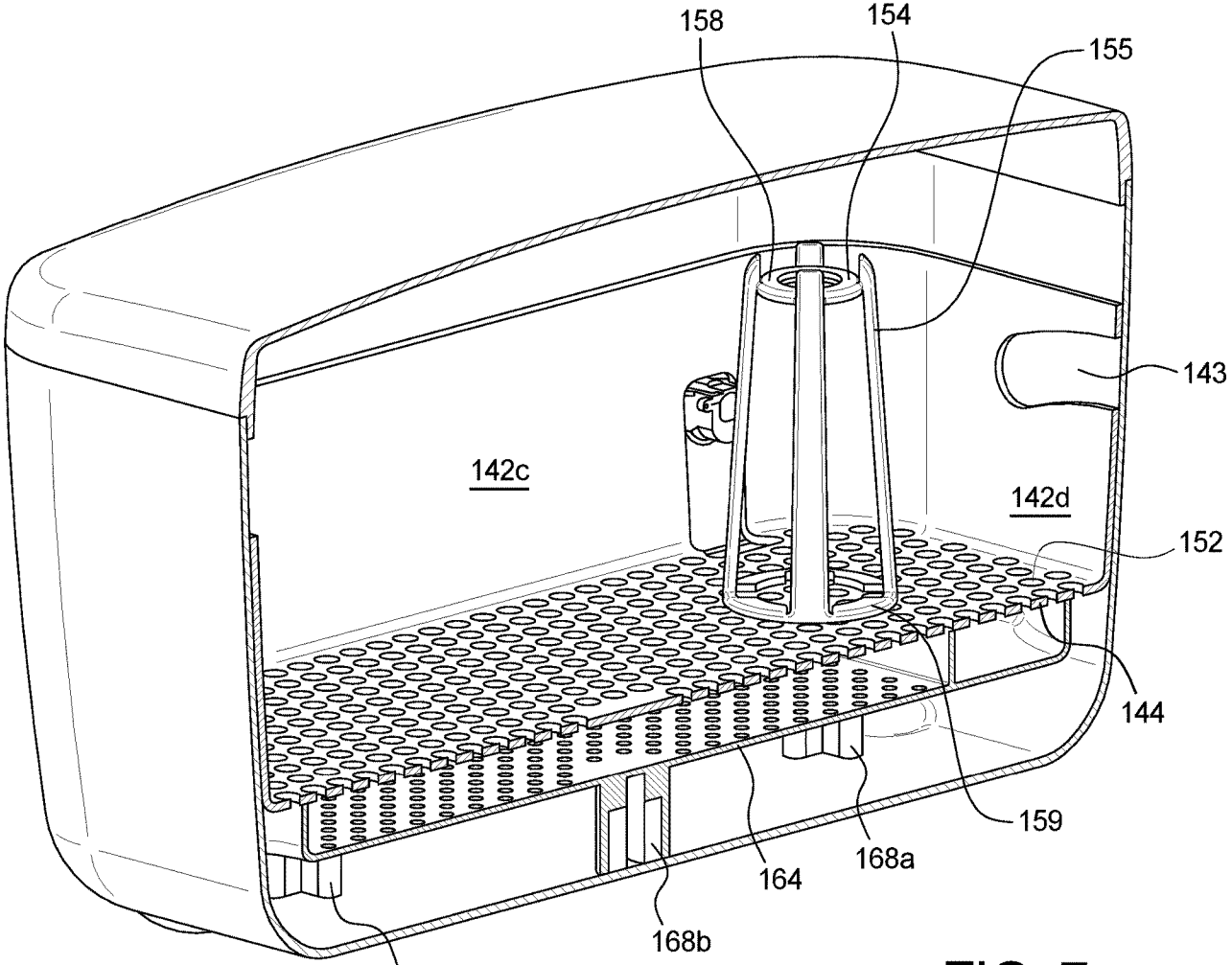
Figure 8:
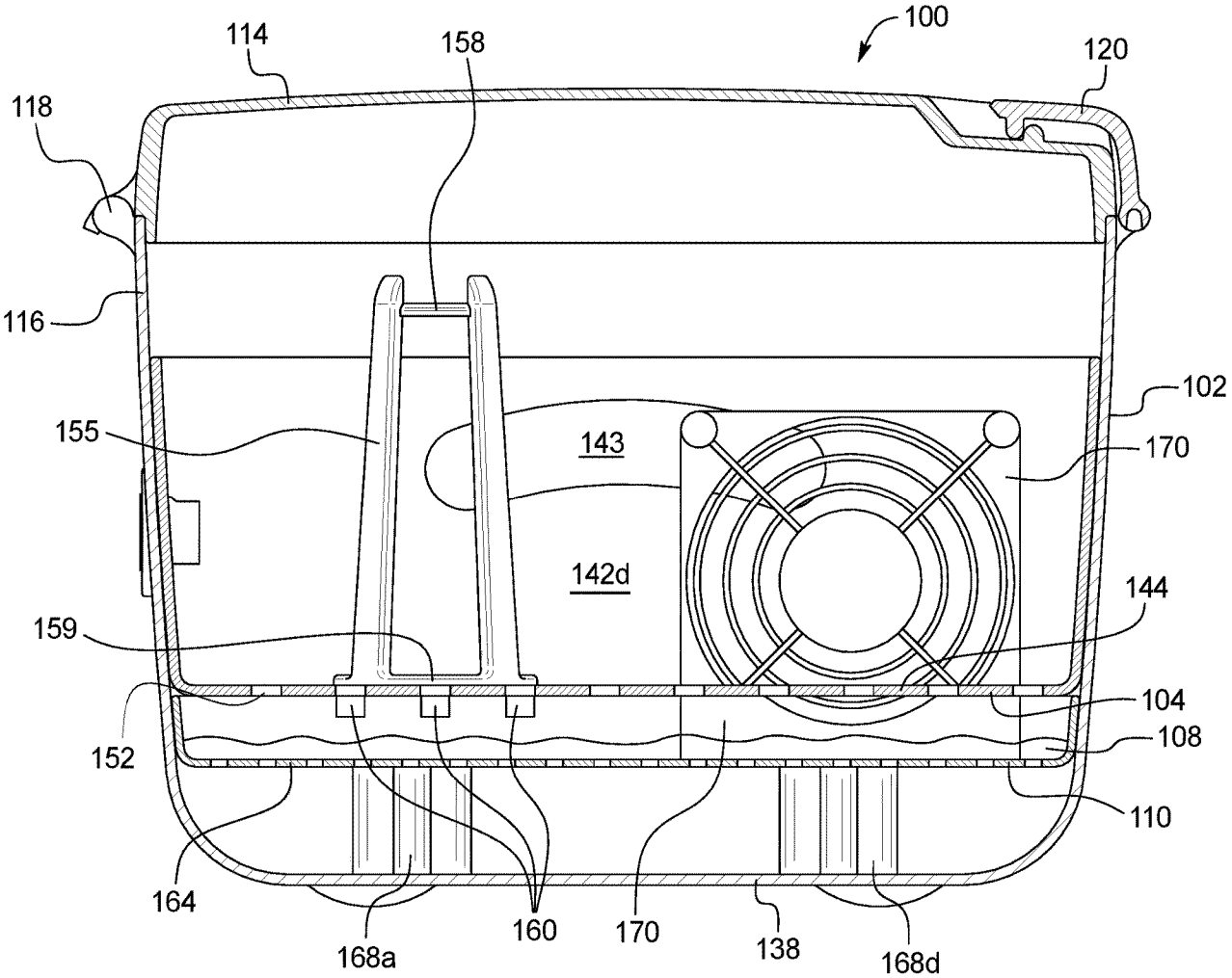
FIG. 8 is a sectional view of the drying device generally taken along the lines 8-8 of FIG. 1.
Figure 9:
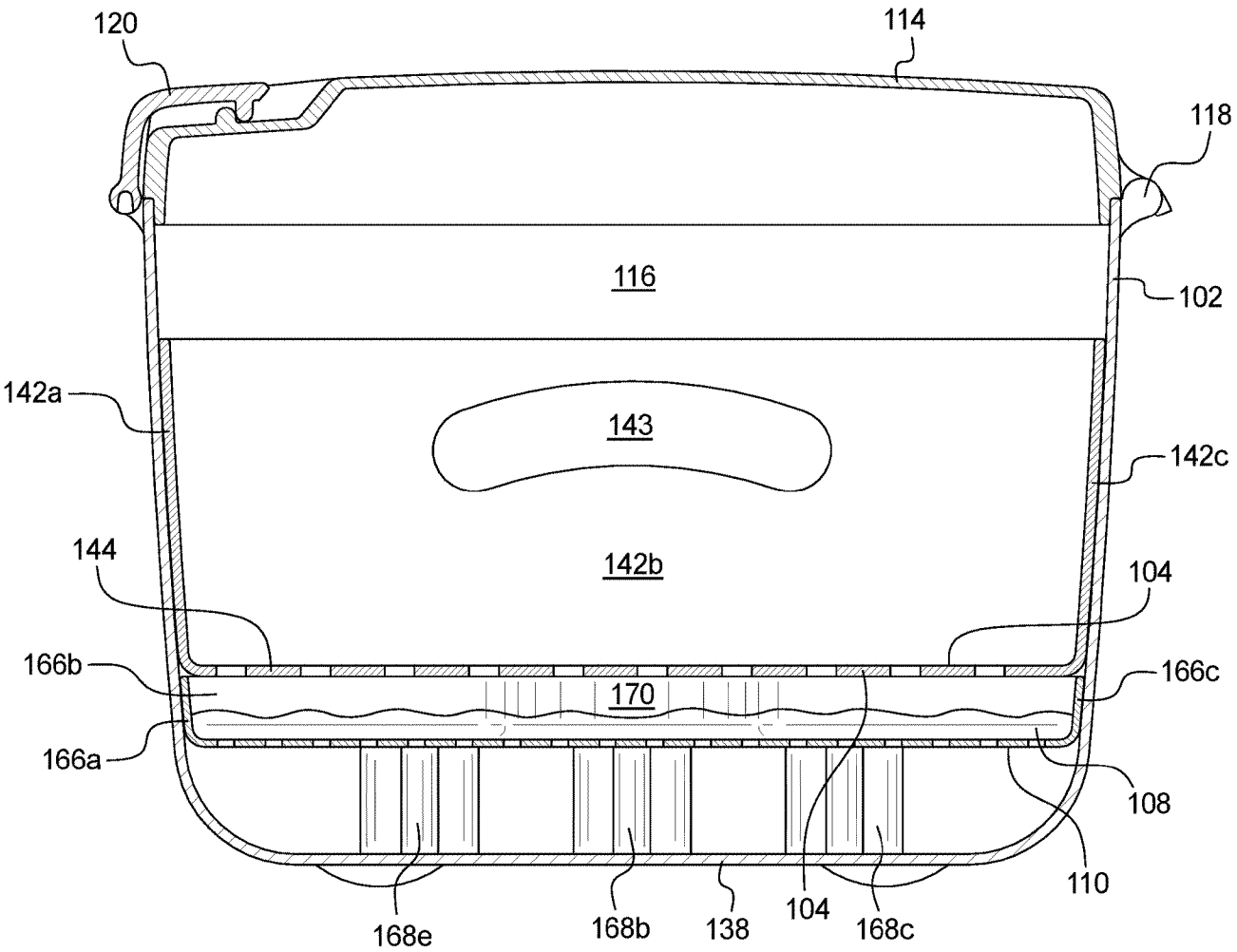
FIG. 9 is a sectional view of the drying device generally taken along the lines 9-9 of FIG. 2.
Figure 10:
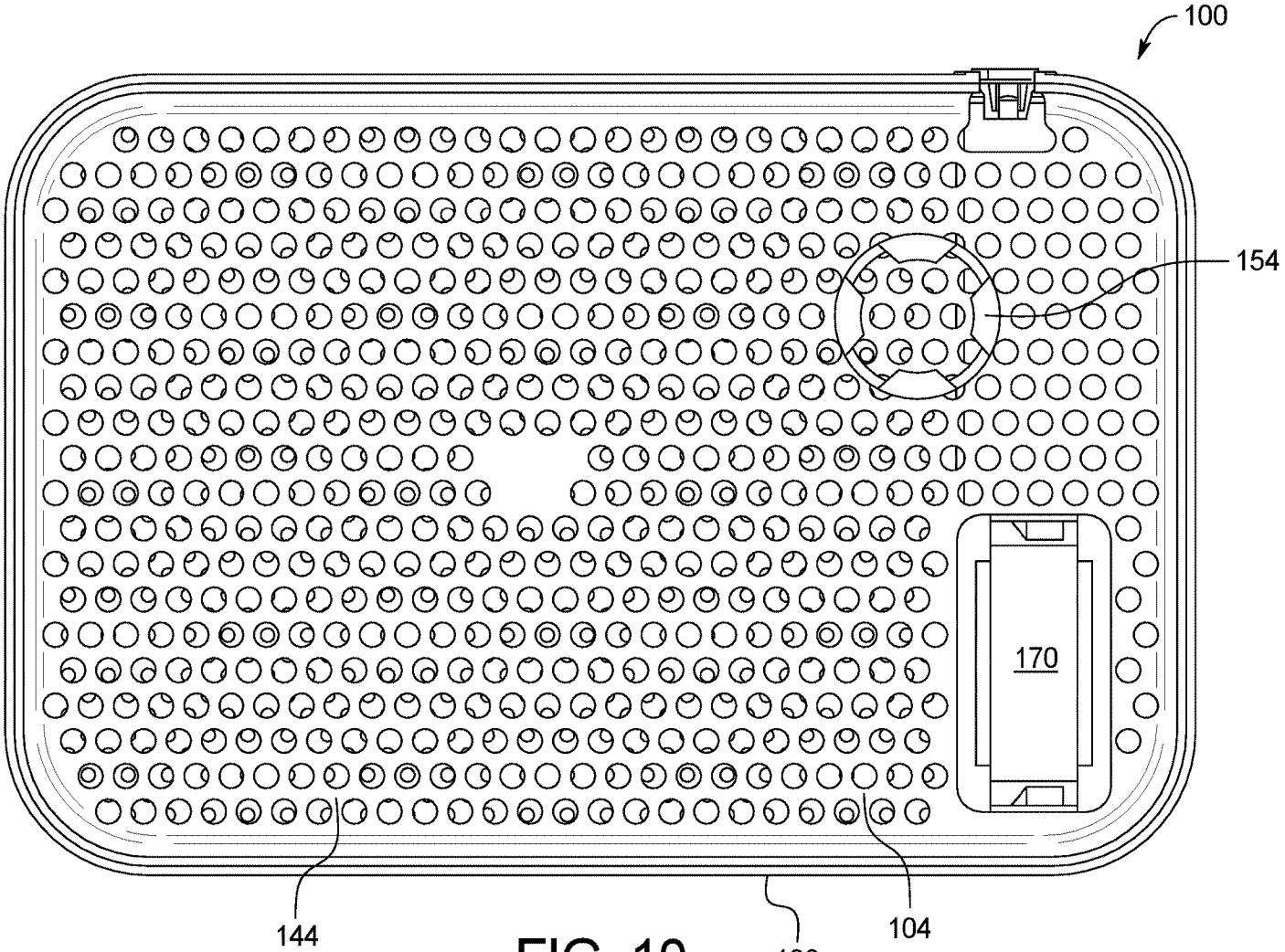
FIG. 10 is a plan view of the drying device of FIG. 1 with the lid removed.

In the embodiment illustrated in FIGS. 1-9, an upright member 154 extends upwardly from the insert surface 144 into the damp item 106, such as the heel 156 of a shoe 157 (as shown in FIG. 6) and/or the tongue and laces of the shoe 157 (not shown), in order to direct airflow to the bacteria in the interior of the damp item 106. In the illustrated embodiment, the upright member 154 includes four strips of material 155 extending between a proximal base 159 and a distal end 158. Referring to FIG. 8, one or more plugs 160 project downwardly from the base 159 into one or more openings 152, respectively, of the insert surface 144. The upright member or shoe forms 154 may be formed integral with or removable from the insert 104. Further, the upright member 154 may be provided in different sizes to accommodate different sized shoes. While the damp item 106 of the embodiment illustrated in FIGS. 1-9 is a shoe 157, other damp items such as socks or athletic gear may be dried using the upright member 154.

The upright member 154 may have other shapes and dimensions. In another embodiment, the upright member 154 comprises a shoe form including a height that decreases between an outer end and an inner end to define an angled opening. In other embodiments, the upright member 154 includes two parts, each part having three pins extending from a rod. Each part is secured to the insert 104 by positioning the pins through the openings 152 of the insert 104. The user may select the locations and spacing of the shoe form parts in order to position the damp item in such a way to optimize airflow into and/or toward the damp item.

Referring again to FIGS. 6-9, the tray 110 is perforated to allow water to drain through while the desiccant 108 continuously adsorbs moisture from the air. The tray 110 includes tray sides 166*a*-166*d* extending upwardly from a tray surface 164. In some embodiments, the tray sides 166*a*-166*d* are tapered and nest within the tapered container sides 128*a*-128*d* to maintain a positioning of the tray 110 spaced from the bottom 138 of the container 102.

Five spacers 168*a*-168*e* extending from the underside of the tray surface 164 rest on the container bottom 138 to maintain a spacing between the insert 104 and the tray 110 of about 1 to 3 cm and a spacing between the tray 110 and the bottom 138 of the container 102 of about 1 to 3 cm. The tray 110 may be disposable. Finger cut-outs 171 or other lifting attachments may be formed within or attached to the tray 110.

In another embodiment, the drying device may include a first container including a width and a height and a planar surface, wherein the container surface includes a plurality of openings, and a second container including a width and a height whereby the first and second containers are releaseably held together. The first container acts as the insert as described above, in that the item to be dried is positioned within the first container. A perforated tray is positioned parallel to the width of the second container at a point along the height between the top and bottom of the second container, and a desiccant material positioned on the tray.

The desiccant 108 may comprise anhydrous calcium chloride, silica gel, activated charcoal, clay, a molecular sieve such as crystalline metal aluminosilicates having a three dimensional interconnecting network of silica and alumina tetrahedral, any combination thereof, or any other suitable material to absorb moisture from the air.

A fan 170 such as a computer case cooling fan may also be included to increase air movement within the container 102 and expedite the drying process. The fan 170 may be mounted to the tray surface 164 as shown in FIG. 8, to the insert 104, to the insert 110, under the lid 114, and/or to the container sides 128*a*-128*d*. The illustrated embodiment shows the fan 170 as a component of the device 100, although the fan 170 may be provided as a separate accessory to the device 100. The fan 170 may be powered by a USB battery or a standard battery. Alternatively, the fan 170 may include a power cord extending through an opening 145 in the container 102 for insertion into a standard AC outlet. A timer and/or an automatic shutoff feature for the fan 170 may also be included.

The container body 116, insert 104, and tray 110 may comprise a plastic material and be formed using injection molding, although other manufacturing processes may be used as desired. The planar surface 164 of the tray 110 may comprise a mesh material.

During use, the user opens the container 102 and places the tray 110 having desiccant 108 disposed thereon into the bottom 138 of the container 102. The user then places the insert 104 within the container 102 and positions the the damp item 106 on the upright member 154 as shown in FIG. 6. If included, the fan 170 may be activated. The lid 114 is then closed and latched. In some cases, the use of the device 100 with the fan 170 may effectively dry the damp item 106 within about 1 to 12 hours, whereas other embodiments without the fan 170 may dry the damp item 106 within 24 to 48 hours, depending on the degree of dampness. Periodically, the tray 110 may be removed to replace the desiccant 108 and/or to remove water from the bottom 138 of the container 102.

Figure 11:
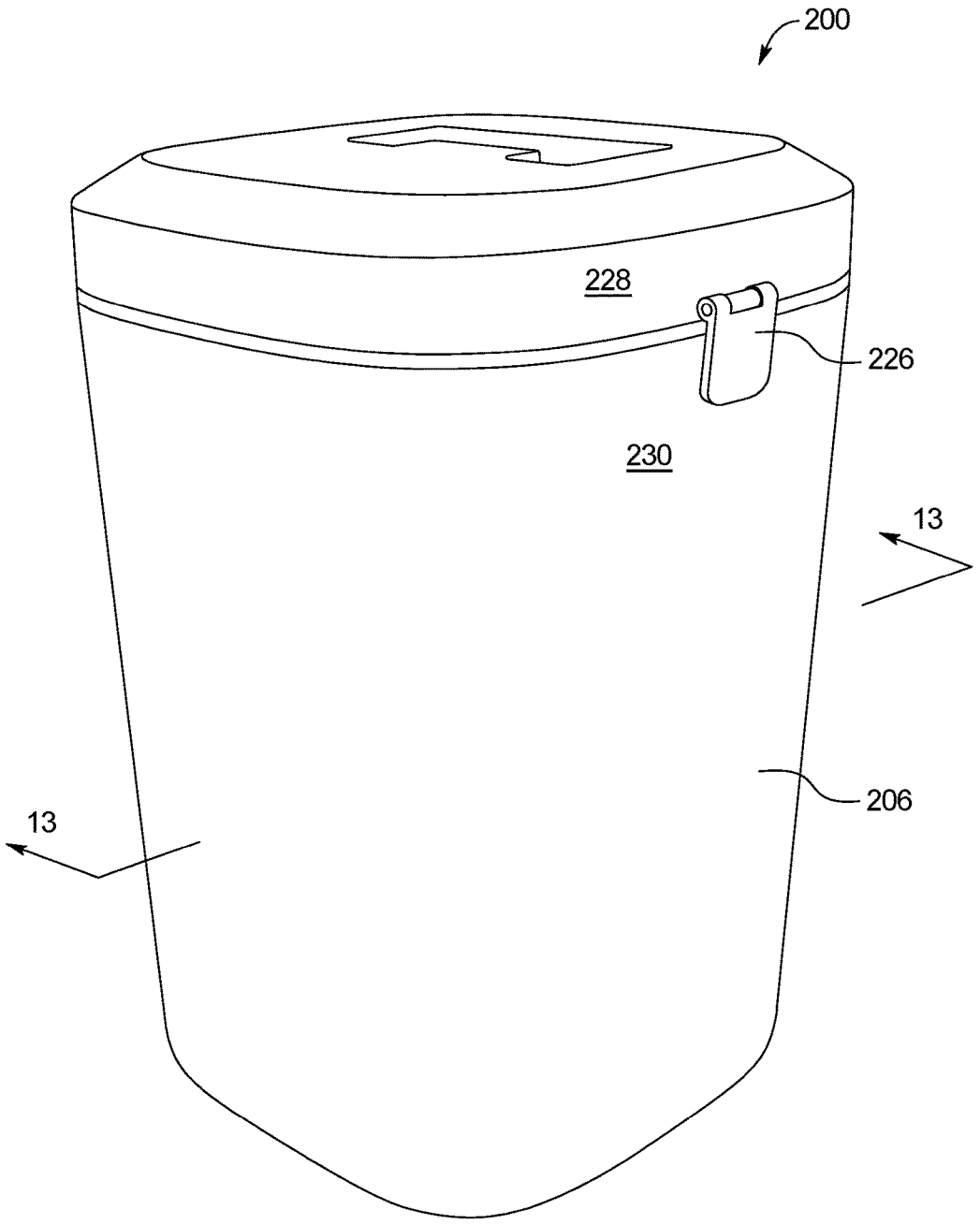
FIG. 11 is an isometric view from above of a further embodiment of a drying device.
Figure 12:
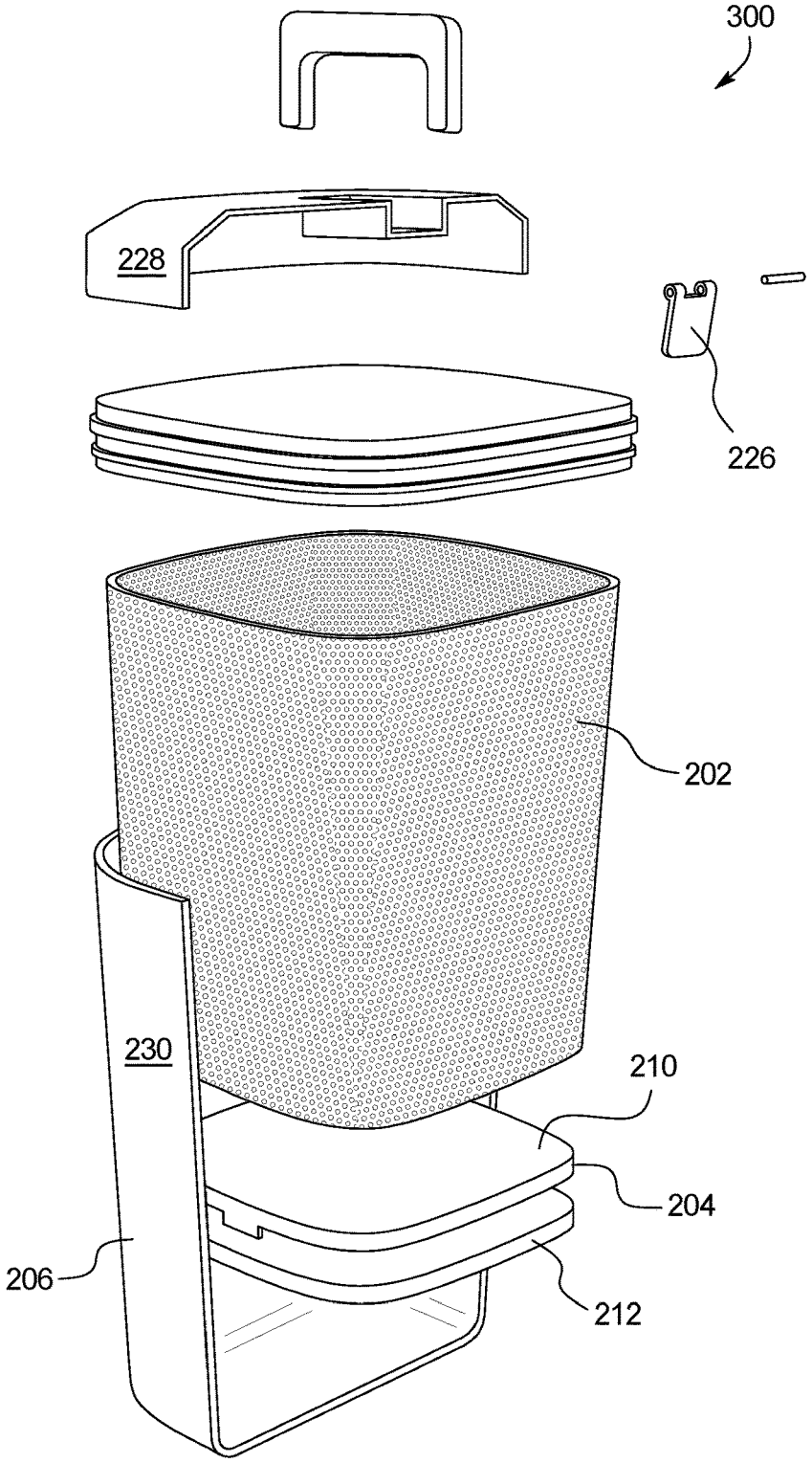
FIG. 12 is an exploded, isometric view from above of the drying device of FIG. 11.

A further embodiment of a drying device 200 is shown in FIGS. 11-13. As shown in the drawings, the drying device 200 includes the components as described above, and differs primarily in shape and size. The device 200 includes an insert 202 and a tray 204 having desiccant 208 (FIG. 13) disposed thereon positioned within a container 206. Side walls of the container 206 and the insert 202 are planar and vertical. The tray 204 includes first and second planar tray surfaces 210, 212 separated by a tray wall 214. The insert 202 rests atop the tray 204. A latch 226 may secure a lid 228 to a body 230 of the container 206.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. An apparatus for drying an item comprising:

a container including a width and a height, wherein the container includes a plurality of container walls surrounding a bottom of the container;

an insert including a planar surface positioned parallel to the width at a first point along the height and extending fully between the plurality of container walls, wherein the planar surface includes a plurality of openings and supports the item to be dried;

a perforated tray positioned parallel to the width at a second point along the height between the insert and the bottom of the container and extending fully between the plurality of container walls; and a desiccant material positioned on the tray.

2. The apparatus of claim 1, further comprising a lid that encloses an interior of the apparatus when closed.

3. The apparatus of claim 1, wherein the apparatus further comprises at least one fan that is positioned on at least one of the tray, the insert, and the container walls.

4. The apparatus of claim 1, further comprising at least one upright member formed integrally with the insert or held within one or more openings of the plurality of openings of the insert.

5. The apparatus of claim 4, wherein the at least one upright member is releaseably held within the one or more openings.

6. The apparatus of claim 4, wherein the at least one upright member is permanently held within the one or more openings.

7. The apparatus of claim 1, wherein the container includes container sides and a bottom, and wherein the container sides taper inwardly from a first width adjacent the top to a second width adjacent the bottom.

8. The apparatus of claim 7, wherein the tray includes tapered tray sides extending upwardly from a tray surface, and wherein the tapered tray sides nest within the tapered container sides to maintain a positioning of the tray spaced from the bottom of the container.

9. The apparatus of claim 7, wherein the insert includes tapered insert sides extending upwardly from the planar surface, and wherein the tapered insert sides nest within the container sides to maintain a positioning of the insert spaced from the bottom of the container.

10. The apparatus of claim 1, wherein the tray further comprises at least one support that rests on the bottom of the container.

11. An apparatus for drying an item comprising:

a container including a width and a height, wherein the container includes a plurality of container walls surrounding a bottom of the container;

an insert including a planar surface positioned parallel to the width of the container and extending fully between the plurality of container walls, wherein the planar surface includes a plurality of openings;

at least one upright member formed integrally with the insert or held within one or more openings of the plurality of openings of the insert; and a desiccant material.

12. The apparatus of claim 11, further comprising a perforated tray positioned parallel to the width of the container adjacent to a bottom of the container.

13. The apparatus of claim 11, wherein the insert is releaseably joined with the container along the height.

14. The apparatus of claim 11, further comprising at least one fan.

15. The apparatus of claim 11, wherein the container includes container sides, a top and a bottom, and wherein the container sides taper inwardly from a first width adjacent a top to a second width adjacent a bottom.

16. The apparatus of claim 15, wherein the insert includes tapered insert sides extending upwardly from the insert planar surface, and wherein the tapered insert sides nest within the container sides to maintain a positioning of the insert spaced from the bottom of the container.

17. The apparatus of claim 12, wherein the tray further comprises at least one support that rests on the bottom of the container.

18. A method of drying an item comprising:

providing a container having a closeable lid, an insert, and a perforated tray, wherein the insert is disposed above a perforated tray within the container, and wherein a desiccant material is positioned atop the perforated tray;

positioning the item on the insert;

closing the lid of the container; and allowing the container to remain closed for a period of time.

19. The method of claim 18, wherein at least one upright member is positioned on the insert, and wherein the positioning step of positioning the item comprises positioning the item on the upright member prior to the closing step of closing the lid of the container.

20. The method of claim 18 wherein the container limits an exchange of air moving between an inside and an outside the container.

21. The method of claim 18, wherein the container includes at least one fan, and wherein the method further comprises a step activating the fan.

22. The apparatus of claim 1, wherein the insert is releaseably joined with the container at a point along the height.

23. The apparatus of claim 22, further comprising a lid that encloses an interior of the apparatus when closed.

24. The apparatus of claim 2, wherein the container includes a plurality of container walls, and wherein the apparatus further comprises at least one fan that is positioned on at least one of the tray, the insert, the lid, and the container walls.

25. The apparatus of claim 2, wherein the lid is attached to the container to enclose an interior of the apparatus when closed.

26. The apparatus of claim 11, further comprising a lid that encloses an interior of the apparatus when closed.

27. The apparatus of claim 26, wherein the lid is attached to the container to enclose an interior of the apparatus when closed.

28. The apparatus of claim 13, further comprising a lid that encloses an interior of the apparatus when closed.

* * * * *